United States Patent [19]

Frangos

[11] 3,981,396

[45] Sept. 21, 1976

[54] SAFETY MATCHBOOK

[76] Inventor: Peter W. Frangos, 39 Salem Ave., Cranston, R.I. 02920

[22] Filed: May 8, 1975

[21] Appl. No.: 575,494

[52] U.S. Cl. ..... 206/109

[51] Int. Cl.[2] ..... A24F 27/12; A24F 27/00

[58] Field of Search ..... 206/108, 109, 106, 107, 206/110, 111, 112, 113, 114, 115

[56] References Cited

UNITED STATES PATENTS

| | | | |
|---|---|---|---|
| 1,232,300 | 7/1917 | Handler et al. | 206/115 |
| 1,853,279 | 4/1932 | Lonkowski | 206/107 |
| 2,217,854 | 10/1940 | Baldwin | 206/109 |
| 2,249,168 | 7/1941 | Premo | 206/109 |
| 2,935,184 | 5/1960 | Olson | 206/109 |

*Primary Examiner*—William T. Dixson, Jr.
*Attorney, Agent, or Firm*—Morse, Altman, Oates & Bello

[57] ABSTRACT

A safety cover is provided for matchbooks whereby individual matches may be struck with the head safely enclosed within a sleeve formed integral with the cover in order to make it difficult for the matches to be struck by children and avoid accidental ignition of other matches in the book should the cover be open and a match struck. The matchbook includes a conventional stick of cardboard matches with a cardboard flap cover attached along the baseline of the matches and an abrasive striking surface on the lower edge of the book. The abrasive strip is enclosed within a folded extension of cardboard, aluminum or the like to form a tubular enclosure or sleeve. The match is struck by simply tearing off the match from the stick of matches, inserting the head of the match in the sleeve, pressing against the outside of the sleeve and then pulling the match outwardly in a sharp stroke.

1 Claim, 4 Drawing Figures

SAFETY MATCHBOOK

BACKGROUND OF THE INVENTION

1. Field of the Invention

This invention relates generally to matchbooks and more particularly is directed towards a new and improved matchbook which is difficult for a child to use and designed to prevent accidental ignition of one or more matches.

2. Description of the Prior Art

In a conventional book of safety matches, a stick of typically 20 cardboard matches is mounted in a double row to a cardboard cover wherein the flap is normally closed behind a lower fold. Typically, an abrasive strip is applied to the lower fold by means of which the match may be ignited by striking the head of the match across the abrasive strip. Many children find matches fascinating to play with and, as a result, often suffer burns by lighting matches that are easy to strike. Also, despite printed warnings on almost all matchbooks of this type to close the cover before striking, many persons persist in striking the match with the cover open. This practice, in many instances, results in all of the matches being accidently ignited when only a single match is intended to be struck. The sudden ignition of one match in such close proximity to other exposed matches frequently will ignite all of the other matches often causing serious burns, fires or other mishaps to those involved. While various types of matchbooks and match cases have been devised in an attempt to resolve this problem, none of these has been entirely satisfactory from the standpoint of effectiveness and cost.

Accordingly, it is an object of the present invention to provide a simple, low cost means for reducing the risk of accidental ignition of matches in a book of matches. Another object of this invention is to provide a safety book of matches which is difficult to ignite by a child and also to provide protection against accidental ignition of other matches remaining in the book.

SUMMARY OF THE INVENTION

This invention features a safety book of matches, comprising a stick of cardboard matches normally enclosed within a cover comprised of front and rear flaps and a short lip along the lower front edge of the book serving to secure the front flap. An abrasive material is applied to the face of the lower lip for striking purposes. The abrasive material is obscured by a sleeve that is co-extensive with the abrasive material whereby the match may be struck only by inserting the head thereof within either end of the sleeve, pressing the head against the abrasive material and then pulling the match out in a quick, short stroke. The manipulation required is thereby easily done by an adult, but difficult for a child to perform. In addition, the sleeve covering of the match during the striking operation minimizes the risk of ignition of other matches within the book, particularly if the front flap is still open.

DETAILED DESCRIPTION OF THE PREFERRED EMBODIMENTS

Figure 2:
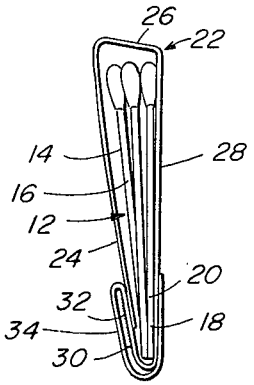
FIG. 2 is a view in side elevation thereof.
Figure 3:
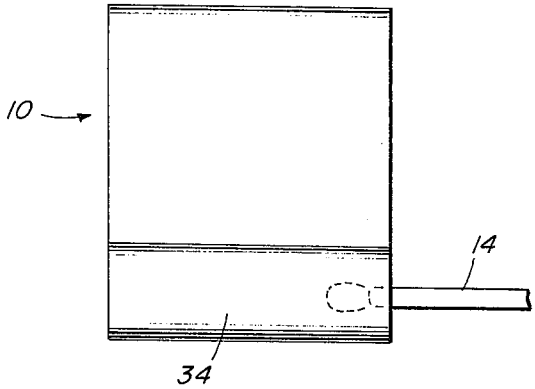
FIG. 3 is a view in front elevation, and, FIG. 4 is a view in side elevation showing a modification of the invention.
Figure 1:
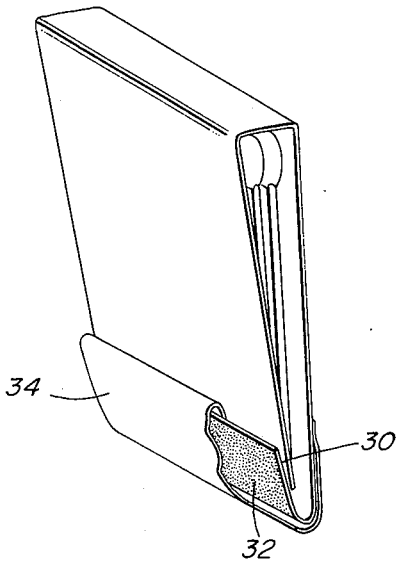
FIG. 1 is a view in perspective, partly broken away, showing a matchbook made according to the invention.

Referring now to the drawings and to FIGS. 1, 2 and 3, in particular, the reference character 10 generally indicates a safety matchbook comprised of a stick 12 of typically twenty matches 14. Each stick of matches is fabricated from cardboard stems 16 connected to a common base strip 18 by means of a tear line 20 by which each match may be broken off for use. The stick 12 is normally closed by means of a cardboard cover 22 of one-piece construction comprised of a front flap 24, a transverse medial top wall 26, a back wall 28 and a lower front lip 30 faced with an abrasive grit 32 providing a striking surface for matches. In practice, the lower free edge of the cover 24 is kept closed by inserting it behind the lip 32. Commonly, the lower edge of the book of matches is bound by means of staples or other fastening means.

In accordance with the present invention, the striking surface is enclosed by means of a panel 34 which may be an extension of the lip 30 folded along the top of the lip 30 back down over the abrasive material 32 and then folded again along the bottom of the match book to be attached to the lower part of the back wall 28 by simple means such as a staple, cement or the like. The panel 34, when folded and fastened, forms a sleeve or tube open at both ends by means of which the head of the match 14 may be inserted when the match is to be struck as suggested in FIG. 3.

The panel 34 may fabricated of the same cardboard as the front cover and back wall or may be faced on its inner surface with aluminum foil or the entire panel may be foil. In any event, the panel effectively obscures the striking surface making it difficult for a child to strike a match. Matches may be struck by tearing one from the book, closing the cover and then inserting the bead at either end of the tube formed by the panel 34 as shown in FIG. 3. The thumb of one hand then may be pressed against the panel 34 over that portion where the head of the match is located and, gripping the match by the fingers of the other hand, the match is pulled out of the sleeve in a quick, sharp stroke. This action will normally ignite the match in a safe and convenient manner. The procedure is relatively simple to perform by an adult but would be difficult for a child to use since the striking surface is obscured from view and most children would find it difficult to insert the head of the match in the restricted end of the tube formed by the panel 34. Even if the child were able to insert the head into the tube, he would face the further task of pressing the panel oppositely the head and then pulling out the match in a proper manner.

Figure 4:
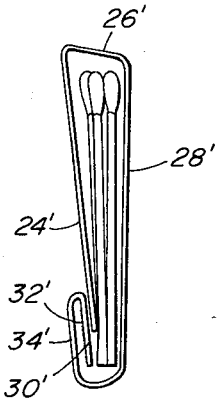

Referring now to FIG. 4 of the drawings, there is illustrated a modification of the invention and, in this embodiment, the entire outer cover, including the tubular sleeve, is of one-piece construction to facilitate manufacture of the matchbook. As shown, the outer cover is comprised of a front flap 24', a medial top wall 26', a back wall 28', a lower panel 34' and a lip 30' covered by abrasive material at 32'. The lip 30' is a continuation of the panel 34' and is folded down with the end terminating at the lower edge of the stick of matches. As before, the cover 24' is closed by inserting the lower free edge thereof between the lip 30' and the base of the matches.

Although the invention has been described with particular reference to the illustrated embodiments, numerous modifications thereto will appear to those skilled in the art. For example, instead of the abrasive surface and protective tube being located on the front of the matchbook, they may be formed on the back thereof directly opposite the lip.

Having thus described the invention, what I claim and desire to obtain by Letters Patent of the United States is:

1. A safety matchbook, comprising a. a plurality of matches connected to one another along a common base, b. a cover attached to said matches to form a book, c. said cover including a front flap, a back wall integral with said flap and attached to said base to form a book, d. a lip connected to said back wall and to said base, e. a wall forming a substantially flat tube open from end-to-end connected to one side of said cover at the base thereof, said tube being integral with said cover and extending transversely thereof for the full width thereof, and, f. a stratum of abrasive material disposed in a continuous strip along the inner face of said tube for the full length thereof, and a stratum of aluminum foil disposed in a continuous strip along the inner face of said tube opposite to and coextensive with said abrasive stratum.

* * * * *